United States Patent [19]

St.-Michel

[11] Patent Number: 4,642,268

[45] Date of Patent: Feb. 10, 1987

[54] WOOD SUBSTRATE HAVING GOOD FLAME RESISTANCE

[75] Inventor: André St.-Michel, Lorraine, Canada

[73] Assignee: Domtar Inc, Montreal, Canada

[21] Appl. No.: 784,060

[22] Filed: Oct. 4, 1985

[51] Int. Cl.[4] ..... B32B 23/08

[52] U.S. Cl. ..... 428/453; 162/159; 427/397.8; 427/428; 427/440; 428/326; 428/537.1; 428/921

[58] Field of Search ..... 428/537.1, 453, 921, 428/326, 489; 427/397.8, 428, 440; 106/18.12; 162/159

[56] References Cited

U.S. PATENT DOCUMENTS

| | | | |
|---|---|---|---|
| 3,811,992 | 5/1974 | Handa et al. | 428/453 |
| 3,900,690 | 8/1975 | Schwarz | 428/453 |
| 4,122,236 | 10/1978 | Holman | 428/453 |
| 4,187,346 | 2/1980 | Jarrett | 428/537.1 |
| 4,212,920 | 7/1980 | Seamans | 428/453 |
| 4,338,374 | 7/1982 | Neser | 428/537.1 |

*Primary Examiner*—Paul J. Thibodeau

*Attorney, Agent, or Firm*—Antoine H. Gauvin

[57] ABSTRACT

A wood substrate having good flame resistance characteristics while substantially maintaining its adherence characteristics for asphalt products. One surface of the wood substrate has a coating of an inorganic soluble silicate impregnating the wood substrate and forming a firm bonding with it. A process which is disclosed comprises: (a) coating at least one surface of a wood substrate with a concentrated solution of an inorganic soluble silicate, and (b) drying said coating as to leave on said surface the inorganic silicate impregnating the wood substrate and form a firm bonding with the wood substrate.

8 Claims, 2 Drawing Figures

WOOD SUBSTRATE HAVING GOOD FLAME RESISTANCE

FIELD OF THE INVENTION

Figure 1:
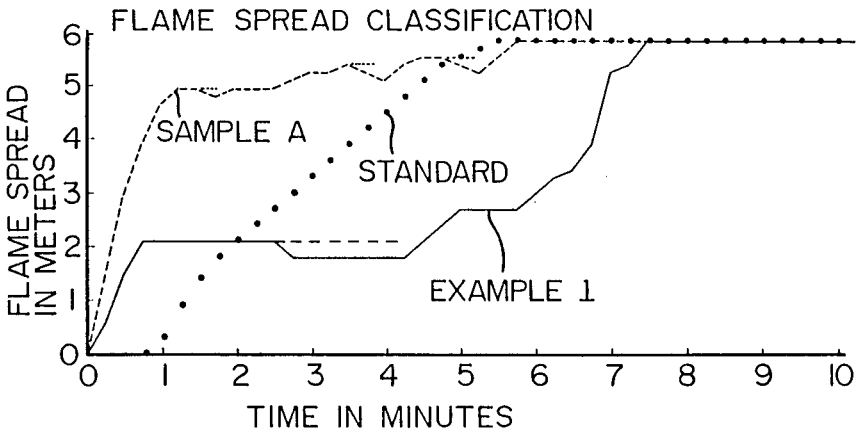

This invention relates to a wood substrate having good flame resistance characteristics, while maintaining substantially its characteristics of adherence for bituminous roofing sheets and the like and to a process for making same. This invention relates in particular to roofing boards or sheathing.

BACKGROUND OF THE INVENTION

Several decades ago, a new roofing process was developed, whereby an asphalt roll, also referred to as an elastomeric modified bituminous roofing sheet, is unrolled and laid against a sheathing surface, a torch system being used between the asphalt roll and the sheathing surface for bonding the asphalt to the sheathing. During those years, experience has taught that the sheathing surface must be handled with care and that this system is fire hazardous, so that so that fire extinguishers are required for each torch unit at the immediate work area for the emergencies used as the sheathing surface caught fire. The sheathing is a wood substrate, such as a fiberboard, a wafer board, particle board and can even be plywood. Notwithstanding this problem since the 1950's, there has been no way of reducing these fire hazards.

Applicant has tried to develop a sheathing surface which would be fire resistant and yet would yield the suitable characteristics required for a sheathing surface. In particular, the sheathing surface must be such as to permit good and strong adhesion of the asphalt to it.

Applicant also aims at making a method which would not require substantial changes in the making of these wood substrates.

Among the preferred sheathing that is known, is a fiber board of mat-formed wood particles pressed and then dried to remove the excess water. The mat is formed by laying a wood pulp over a forming mat. Another sheathing which is known is a fiberboard wherein the wood particles pulp used for making the mat contains asphalt thereby yielding an asphalt impregnating sheathing.

One would think that such a wood sheathing would be easy to fireproof. Such is not the case, because fireproofing agents must be compatible with the sheathing and leave the functions of the sheathing umimpaired such as being able to form a good bond with asphalt. The bonding between the wood on the one hand and the asphalt on the other, is of the essence.

BROAD DESCRIPTION OF THE INVENTION

Applicant has now been able to produce a sheathing to be used in association with asphalt rolls which is fire resistant and yet which keeps its ability to form a good bond with asphalt.

Broadly stated, the invention is directed to a wood substrate having good flame resistance characteristics, while substantially maintaining its adherence characteristics for asphalt products, characterized by having on at least one of its surface, a coating of an inorganic soluble silicate impregnating said wood substrate and forming a firm bonding with the wood substrate.

The invention is also directed to the process of making a wood substrate having good flame resistance characteristics while substantially maintaining the adherence of the substrate for asphalt, which comprises coating at least one surface of a wood substrate with a concentrated solution of an inorganic soluble silicate, and drying said coating as to leave on said surface the inorganic silicate impregnating the wood substrate and form a firm bonding with the wood substrate.

Further features, objects and advantages will be evident from the following detailed description of the preferred embodiments of the present invention in which:

FIG. 1 is a graph illustrating the surface burning of a product obtained in accordance with the present invention (Example 1 shown as continuous line), as compared to a product obtained in accordance with the prior art (Sample A shown as discontinuous line) where the abscissa is expressed in time per minute, and the ordinate in meters of plane spread and compared against the standard as shown as a doted line.

Figure 2:
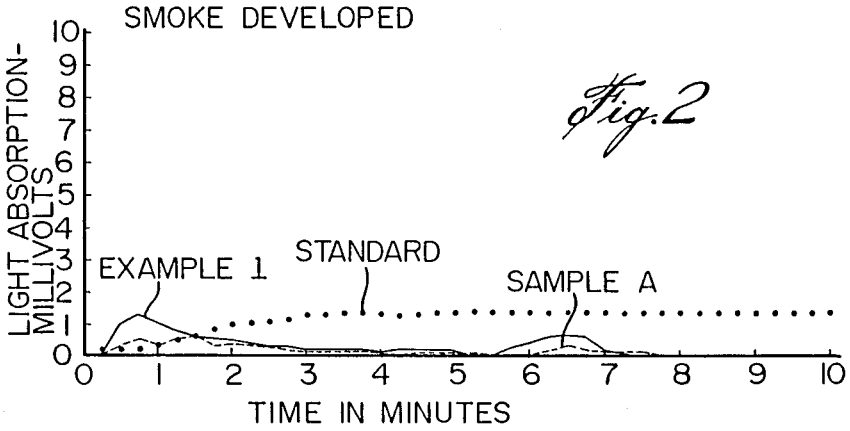

FIG. 2 is a graph illustrating the smoke developed in light absorption millivolts (ordinate) per minute (abscissa), as obtained for Example 1 and Sample A and the standard represented by lines as identified in FIG. 1.

In a preferred embodiment, the invention is used in the process of making a fiberboard, after forming a mat of wood particles over a forming mat, and expelling water by pressing, applying an inorganic soluble silicate on one of the surfaces of the mat of wood particles, preferably sodium silicate on one side of the mat, which side will be designated for exposure to torch unit, thereafter the mat of wood particle is over-dried to remove the excess water. This designated side may be pigmented for easy identification. In a particular embodiment, the water is removed so that final product has in the neighborhood of a 10% water content. If desired, the mat may also be asphalt impregnated: For instance, asphalt may be introduced in the water forming the wood pulp.

The silicate may be applied with a felt applicator roll. As a way of example for a commercial concentrate solution of an inorganic soluble silicate is one available from Silicates National Limitée, Valleyfield, Quebec under the trademark "N" as a liquid syrup having the weight ratio $SiO_2/Na_2O$ of 3.22, containing 8.90% $Na_2O$; 28.7% $SiO_2$, having a density in °Be' of 41.0; a specific gravity 1.394 a viscosity of 180 Centipoises; the density and the viscosity being measured at 20° C.

THE STEINER TEST

Surprisingly enough, if one compares the result of the "Steiner" tunnel test in accordance with ASTM E-84 described in Standard Method of Test for "Surface Burning Characteristics of Building Materials" of an asphalt impregnated sheathing treated in accordance with our invention (Example 1) against untreated (Sample A). It can be easily seen that the asphalt impregnated sheathing (Sample A) is rated from a product which does not meet class 3 to one when treated (Example 1) which falls within the requirement of class 2, classified as fire resistant product. Not only does the sheathing meet with requirement but it has also at the same time, kept its valuable characteristics of making a firm bonding with asphalt.

This test determines the relative surface burning characteristics of materials under specific test conditions. Results are expressed in terms of flame spread index (FSI), smoke developed (SD) and fuel contribution (FC), compared to asbestos cement board (designated as 0) and red oak (designated as 100).

SAMPLE PREPARATION

The samples were conditioned to constant mass at a temperature of 23° C., and a relative humidity of 50% prior to testing.

TEST PROCEDURE

The tunnel is preheated to 66±2.8° C., as measured by a floor-embedded thermocouple located 23¼ ft. downstream of the burner ports, and allowed to cool to 40.5± 2.8° C., as measured in the floor of the tunnel 13 ft. from the burners. At this time, the sample, having a total length of 24 ft, is mounted across the ledges, 12 inches above the floor of the tunnel, to form the ceiling.

Upon ignition of the gas burners, the flame spread distance is observed and recorded every 15 seconds. Flame spread distance versus time is plotted ignoring any flame front recessions. If the area under the curve ($A_T$) is less than 97.5 min-ft. FSI=0.515 $A_T$. Smoke developed and fuel contribution are determined by comparing the area under the smoke obscuration curve and the temperature curve for the test sample to those of red oak.

TABLE 1

| | FSI | SD | FC |
|---|---|---|---|
| Example 1 asphalt impregnated sheathing with inorganic silicate fire resistant coating | 59 | 26 | 139 |
| Sample A asphalt impregnated sheathing | 246 | 11 | 207 |

Authorities having jurisdiction usually refer to the following categories:

| Flame Spread Index | Smoke Developed | |
|---|---|---|
| Class 1 or A (Fire Proof) | 0–25 | 450 Maximum |
| Class 2 or B (Fire Resistant) | 25–75 | 450 Maximum |
| Class 3 or C | 75–200 | 450 Maximum |

ADHESION OF TORCHABLE ROOFING MEMBRANE TO SUBSTRATES COATED WITH AND WITHOUT FIRE-RETARDANT

The adhesion strength of bonds between wood substrates and torchable roofing membranes torched to samples of these wood substrates, were determined. The intent of the testing was: to determine the effect of the silicate coating applied to the surface of the wood substrates on the strength of adhesion with roofing felts hot-welded to a wood substrate underlay.

The strength of adhesion of torchable asphalt roofing membranes to substrate samples was determined by testing the shear strength of the joint by tension loading. Each test of a substrate included five specimens. To prepare the specimens, five rectangular specimens for each substrate were cut from one panel randomly taken from each supplied substrate. Strips of an asphalt roll with the same dimensions (50×125 mm) were cut from the torchable asphalt membrane SBS-modified "Soprema Sopralène Flam 80" sheet in CD direction. These asphalt strips were placed on a bench with their bottom side up. Each single asphalt strip was heated by a roofing torch; then, a rectangular specimen was placed, centered, and aligned on the melted asphalt surface of the asphalt roofing to ensure a 50 mm overlap, and slightly pressed down. The dimensions of the fabricated test specimens were 50×200 mm. After 72+ hours of conditioning in standard atmosphere, the specimens were loaded in tension in a universal testing machine using a 150 mm initial jaw separation with an elongation rate of 2%/min (3 mm/min).

TEST RESULTS

As seen from Table 2, it was found that for wood substrates of fiberboard with or without asphalt impregnation, the strength of the bond between the silicate layer and the substrate is of the same order as the strength of the bond maintaining the internal structure. In some cases, the bond joining the silicate to the substrate being even better as evidence from Table 2. The waferboard has a greater internal bond strength than the bond strength between the silicate layer and the substrate but this is of no substantial or material significance, considered as a torchable roofing substrate and the like. In fact, the bond strength between the silicate film and the waferboard substrate is in the range obtained for commonly available fiberboard and these substrates have all improved good flame proof characteristics, and we can conclude that in general the strength of the bond between the silicate layer and the substrate is of substantially the same order of magnitude as that of the strength of the bond maintaining the internal structure.

TABLE 2

| Nature of wood substrate | Mode of Specimen Failure | Average Bond Strength in Shear by Tension Loading kPA × 10′ |
|---|---|---|
| Example 1 | | |
| An asphalt impregnated fiberboard which is silicate coated | Shear in board/asphalt adhesive interply | *12 |
| Sample A | | |
| Same as in Example 1, but without silicate coating | Rupture of fiberboard | >11 |
| Example 2 | | |
| A fiberboard free from asphalt coated with silicate | Shear without fiberboard along the adhesive surface | >10 |
| Sample B | | |
| Same as in Example 2, but without silicate coating | Same as Example 2 | >12 |
| Example 3 | | |
| Waferboard coated with silicate | Shear in board/asphalt adhesive interply | 12 |
| Sample C | | |
| Same as in Example 3, but | Shear within asphalt | 17 |

TABLE 2-continued

| Nature of wood substrate | Mode of Specimen Failure | Average Bond Strength in Shear by Tension Loading kPA × 10' |
|---|---|---|
| without silicate coating | adhesive | |

*The interply bond of the sample is stronger than the strength of the fiberboard section in the test direction.

Although sodium silicate is preferred for economic reasons, other inorganic soluble silicates may be used such as: potassium silicate, ammonium silicates, lithium silicates and high amorphous silica with low sodium.

The process may be used with not only wood substrates such as fiberboard, wafer board, particle board, but also plywood and the like, to obtain reduced flame spread index and satisfactory bond strength. In the case of fiberboards, the most preferred species are those made from spruce woods with or without a minor amount of poplar, aspen and other similar wood species.

The method coating may also include spraying techniques.

EXAMPLE 3

The following will serve to illustrate that the problem is not solved by merely adding fire retardant products.

The following products were used as a coating:

Sample D: $CaCO_3$

Sample E: $Al(OH)_3$

Sample F: Clay

A decrease in fire resistance was obtained with Samples D, E and F. However, the fire resistance materials as described in Samples D, E and F do not form body with the wood substrate but, create skins that are easily removable from wood substrates. All these being much weaker than the internal bonding structure of the wood substrates, the coating on these wood substrates hereby splitting from the wood substrates when one wishes to bond it to elastomeric bituminous roof sheet.

Other modifications can be made to foregoing without departing from the spirit of the invention, as defined in the appended claims.

I claim:

1. A roofing board of the type to be used for roofing with elastomeric modified bituminous sheets selected from the group consisting of fiber board and wafer board, wherein said board is coated on its top surface with a coating consisting essentially of an inorganic water soluble silicate as the sole effective ingredient yielding flame resistance properties to said board, said coating being the sole coating on said roofing board, said coating serving to impregnate said roofing board and forming a firm bond with it, the strength of the bond between the silicate layer and the roofing board being substantially of the same order of magnitude as the strength of the bond maintaining the internal structure of the roofing board, said bond strength in shear being at least 100 kiloPascal, and said top surface of the roofing board, having the property to form on roofing with elastomeric modified bituminous sheets a bond strength of at least 100 kiloPascal.

2. The wood substrate as defined in claim 1 wherein the inorganic silicate is sodium silicate.

3. The roofing board as defined in claim 1 wherein said roofing board is a wafer board.

4. The roofing board as defined in claim 1 wherein said board comprises spruce wood, and wherein the internal shear strength of the board is between 100 and 120 kiloPascal.

5. The process of making roofing board as defined in claim 1 having good flame resistance characteristics while substantially maintaining the adherence of the substrate for asphalt, which comprises: coating one surface of a wafer board with a concentrate solution of an inorganic water soluble silicate as the sole and effective ingredient yielding flame resistance, and adherence characteristics of said coating impregnating said wafer board, said coating being the sole coating of said roofing board, and drying said coating as to leave on said surface the inorganic silicate impregnating the wafer board and form a firm bonding with the wood substrate, the bond strength in shear being at least 100 kilopascal.

6. The process as defined in claim 5 wherein said inorganic silicate is a sodium silicate.

7. The process of making a roofing board as defined in claim 1 wherein the substrate is fiber board and which comprises forming a mat of wood particles, expelling water by pressing said mat, and applying a coating of an inorganic water soluble silicate on one of the surfaces of the mat of wood particles as the sole an effective ingredient yielding flame resistance and adhesive characteristics to the roofing board, said coating being the sole coating on said roofing board and forming a firm bond with it, the bond strength in shear being at least 100 kilopascal.

8. The process of making a roofing board, in the form of a fiber board as defined in claim 7, wherein said inorganic silicate is sodium silicate.

* * * * *